US005335159A

United States Patent [19]

Chen et al.

[11] Patent Number: 5,335,159

[45] Date of Patent: Aug. 2, 1994

[54] PLASTIC LAMP HOLDER

[75] Inventors: Kent Chen, Taipei Hsien, Taiwan; Suleyman O. Sumer, Chapel Hill; Jose M. Pinedo, High Point, both of N.C.

[73] Assignee: Regent Lighting Corporation, Burlington, N.C.

[21] Appl. No.: 885,488

[22] Filed: May 19, 1992 (Under 37 CFR 1.47)

[51] Int. Cl.[5] ..... F21S 1/02

[52] U.S. Cl. ..... 362/421; 362/457; 362/147; 362/287; 362/427; 403/122; 403/131

[58] Field of Search ..... 362/421, 382, 457, 147, 362/394, 419, 802, 287, 427; 403/122, 131, 161, 67; 248/288.3, 288.5

[56] References Cited

U.S. PATENT DOCUMENTS

| | | | |
|---|---|---|---|
| 2,617,619 | 11/1952 | Versen | 362/421 |
| 3,278,203 | 10/1966 | Snyder | 362/421 |
| 4,333,132 | 6/1982 | Paley | 362/421 |
| 4,357,651 | 11/1982 | Mayer | 362/421 X |
| 5,086,379 | 2/1992 | Denison | 362/145 |
| 5,128,841 | 7/1992 | Maglica et al. | 362/421 X |
| 5,132,492 | 7/1992 | Wieder | 362/421 X |

*Primary Examiner*—Larry Jones

*Attorney, Agent, or Firm*—Rhodes Coats & Bennett

[57] ABSTRACT

A multimovable plastic lamp fixture. In the preferred embodiment, the lamp fixture includes a pair of lampholders for supporting a pair of floodlights or the like. Each of the lampholders are attached to a base by means of a ball and socket-type joint. The ball joint is located off-center and provides spherical positioning of the lights. A gasket located in the interior of each socket prevents moisture from entering the base and, in addition, maintains each lampholder in position due to friction. The ball and socket joint includes a knee ball cover having a semi-spherical surface for engaging the ball joint. Tabs located on the outer surface of the knee ball cover limit the rotational movement of each lampholder with respect to the base.

34 Claims, 2 Drawing Sheets

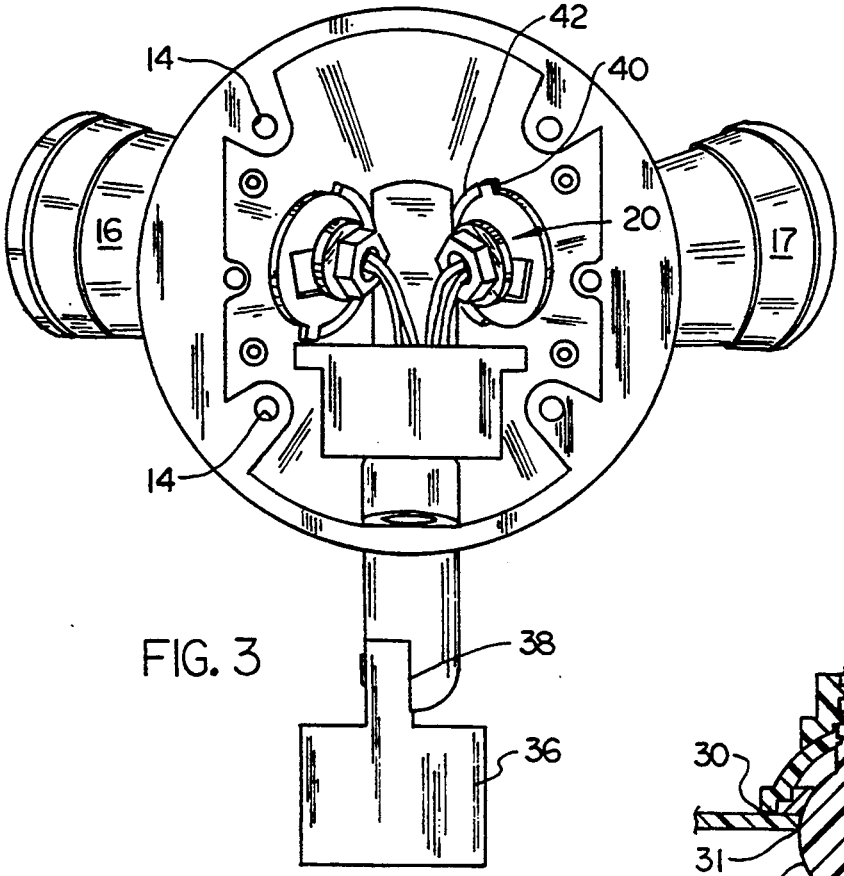
FIG. 3
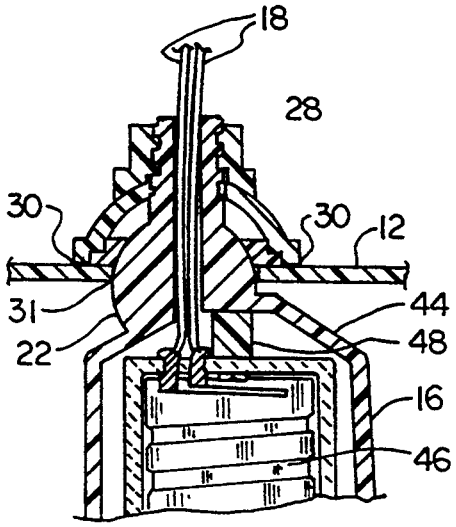
FIG. 5
FIG. 4
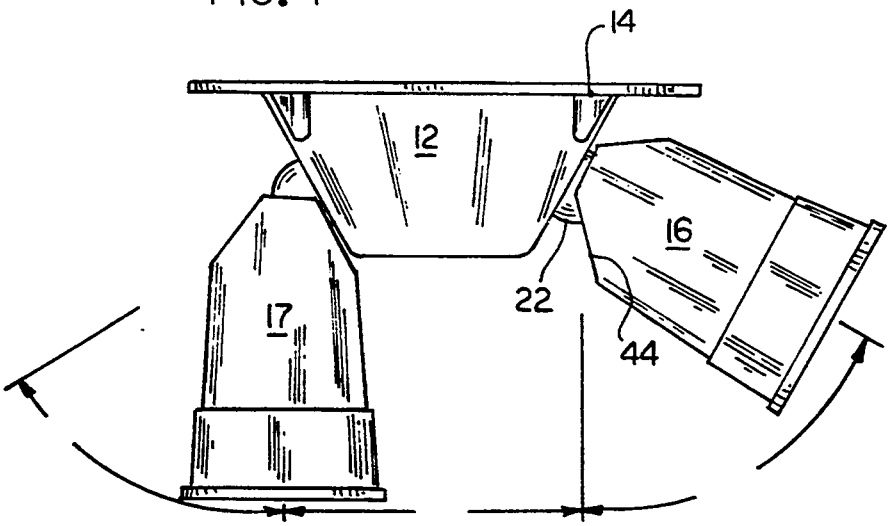

PLASTIC LAMP HOLDER

BACKGROUND OF THE INVENTION (1) Field of the Invention

The present invention relates generally to lighting fixtures and, more particularly, to an outdoor lighting fixture for mounting a pair of floodlights or the like having a sealed swivel unit.

(2) Description of the Prior Art

Outdoor floodlights have been known for many years. In such devices, it is con, non to provide a mechanism in the mounting whereby the direction of the light may be adjusted at least to a limited degree. A common manner in which this is accomplished is by providing a connection between the light fixture and the base by which the fixture may be moved relative to the base and then secured against further motion.

In order to keep the lighting fixture in its selected position, pivotable devices such as thumbscrews and special clamps have been used. Swivel units also have been utilized for such a flexible connection with the construction of the swivel unit being such that the lighting fixture is pivotable about one axis through substantially 90° and pivotable about a second axis at right angles to the first axis through substantially 360°. This combination of pivotable movements enables the fixture to direct light over selected portions of an extensive area.

One type of swivel adjusting lighting fixture utilizes a sphere clamped between two plates thereby causing the sphere to be under compression and allow the sphere to rotate between the plates. The drawback with this type construction is that the wiring of the device is not sealed and therefore, if the device is used outside, moisture and rain may contact the wiring connections and cause a short.

U.S. Pat. No. 4,333,132, issued to Paley, discloses a manually controlled, environmentally sealed swivel unit for use in an adjustable lighting fixture. The swivel unit comprises a base, a housing, a swivel ball device and a means for controlling the rotation of the swivel ball. This arrangement allows the swivel ball to rotate about a first axis and also to rotate about the second axis perpendicular to the first axis. The swivel unit further includes a tension means for forcing the swivel ball controller against the swivel ball device to define a predetermined lamp holding force.

The Denison patent (U.S. Pat. No. 5,086,379) and the Snyder patent (U.S. Pat. No. 3,278,203) disclose two additional examples of swivel or ball-and-socket type joints used in lighting fixtures.

Certain disadvantages become apparent in reviewing these references. In particular, such devices are difficult to assemble and have a large number of parts or do not form an environmental seal. Thus, there remains a need for a new and improved outdoor lighting fixture having a sealed swivel unit including a semi-spherical knee ball cover and gasket combination which is used both to control the tension on the lamp holder ball and the freedom of movement of the knee ball while, at the same time, providing an environmental seal between the lampholder and base.

SUMMARY OF THE INVENTION

The present invention is directed to a multimovable plastic lamp fixture. In the preferred embodiment, the lamp fixture includes a pair of lampholders for supporting a pair of floodlights or the like. Each of the lampholders are attached to a base by means of a ball and socket-type joint. The ball joint is located off-center and provides spherical positioning of the lights, A gasket located in the interior of each socket prevents moisture from entering the base and, in addition, maintains each lampholder in position due to friction. The ball and socket joint includes a knee ball cover having a semi-spherical surface for engaging the ball joint. Tabs located on the outer surface of the knee ball cover limit the rotational movement of each lampholder with respect to the base.

Accordingly, one aspect of the present invention is to provide a lighting fixture. The fixture includes: (a) a lampholder for receiving a floodlight or the like; (b) a base for establishing electrical and mechanical connections with a source of electrical power, the base having a circular aperture for receiving one end of the lampholder; and (c) a ball and socket assembly connected between the base and the end of the lampholder for supporting the lampholder and permitting the lampholder to be manually positioned with respect to the base; the assembly including: (i) a semi-spherically shaped portion attached to the one end of the lampholder and having a diameter larger than the diameter of the circular aperture in the base thereby preventing its passage through the circular aperture; (ii) a stem portion attached to the semi-spherically shaped portion and aligned perpendicularly to the surface of the semi-spherically shaped portion and extending through the circular aperture; (iii) a hemispherical shaped portion adapted to mate with the semi-spherically shaped portion and having an elongated slotted aperture for receiving the stem; and (iv) retaining means attached to the stem for applying a predetermined force on the hemispherical shaped portion.

Another aspect of the present invention is to provide a ball and socket assembly connected between a base and an end of a lampholder for supporting the lampholder and permitting the lampholder to be manually positioned with respect to the base. The assembly includes: (a) a semi-spherically shaped portion attached to the one end of the lampholder and having a diameter larger than the diameter of the circular aperture in the base thereby preventing its passage through the circular aperture; (b) a stem portion attached to the semi-spherically shaped portion and aligned perpendicularly to the surface of the semi-spherically shaped portion and extending through the circular aperture; (c) a hemispherical shaped portion adapted to mate with the semi-spherically shaped portion and having an elongated slotted aperture for receiving the stem; and (d) retaining means attached to the stem for applying a predetermined force on the hemispherical shaped portion.

Still another aspect of the present invention is to provide a lighting fixture. The fixture includes: (a) a lampholder for receiving a floodlight or the like; (b) a base for establishing electrical and mechanical connections with a source of electrical power, the base having a circular aperture for receiving one end of the lampholder; and (c) a ball and socket assembly connected between the base and the end of the lampholder for supporting the lampholder and permitting the lampholder to be manually positioned with respect to the base; the assembly including: (i) a semi-spherically shaped portion attached to the one end of the lampholder and having a diameter larger than the diameter of the circular aperture in the base thereby preventing its passage through the circular aperture; (ii) a stem portion attached to the semi-spherically shaped portion and aligned perpendicularly to the surface of the semi-spherically shaped portion and extending through the circular aperture; (iii) a hemispherical shaped portion adapted to mate with the semi-spherically shaped portion and having an elongated slotted aperture for receiving the stem; sealing means located between the hemispherical shaped portion and the surface of the base adjacent to the aperture; and (v) retaining means attached to the stem for applying a predetermined force on the hemispherical shaped portion.

These and other aspects of the present invention will become apparent to those skilled in the art after a reading of the following description of the preferred embodiment when considered with the drawings.

BRIEF DESCRIPTION OF THE DRAWINGS

FIG. 3 is a rear view of the assembled lighting fixture shown in FIG. 1;

FIG. 4 is a top plan view of the assembled lighting fixture illustrating the range of movement of the lampholders in a horizontal plane; and FIG. 5 is an enlarged sectional view of the swivel assembly of the lighting fixture of the present invention.

DESCRIPTION OF THE PREFERRED EMBODIMENTS

Figure 1:
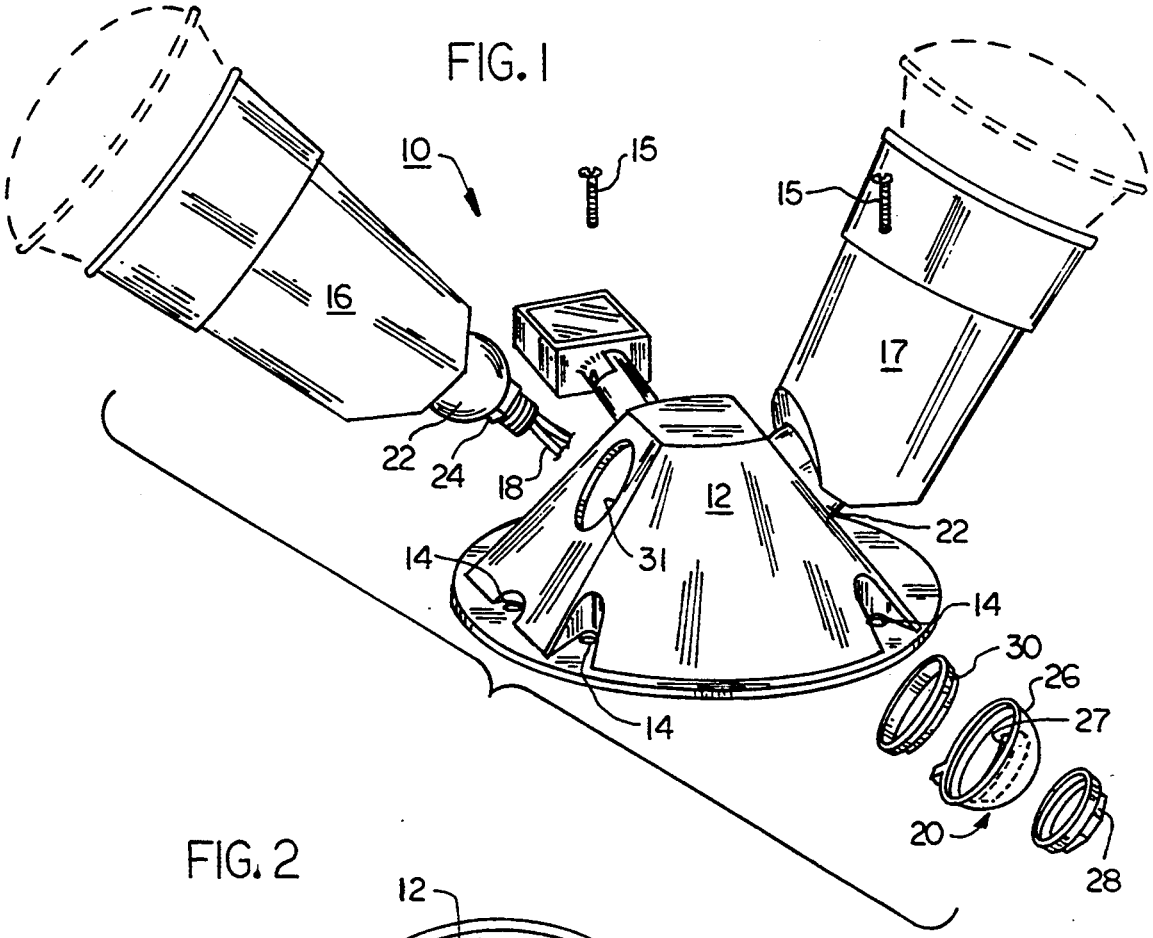
FIG. 1 is an exploded top perspective view illustrating a swivel lighting fixture constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a swivel lighting fixture, generally designated 10, is shown constructed according to the present invention. The lighting fixture 10 includes three major subassemblies: a base 12; lamp holders 16,17; and a ball-and-socket assembly 20.

Base 12 is preferably a truncated polygon having a plurality of recessed apertures 14 located about its periphery for receiving conventional fasteners 15. Preferably the sides of the base form an included angle of about 50°. Lamp holders 16,17 each include electrical leads 18 which pass through ball-and-socket assembly 20 to provide an electrical connection for each lamp holder. Apertures 31 located in opposite side walls of the base receive each lamp holder.

Ball-and-socket assembly 20 includes a semi-spherical portion 22 attached to one end of each lamp holder. A threaded stem 24 extends from semi-spherical portion 22. Hemispherical shaped portion 26 includes a rectangular slot 27 for receiving threaded stem 24. A retaining means 28 maintains the threaded stem in place. Sealing means 30 formed of a neoprene type material is positioned between the hemispherical shaped portion 26 and the inner surface of base 12 adjacent to semi-spherical portion 22.

Figure 2:
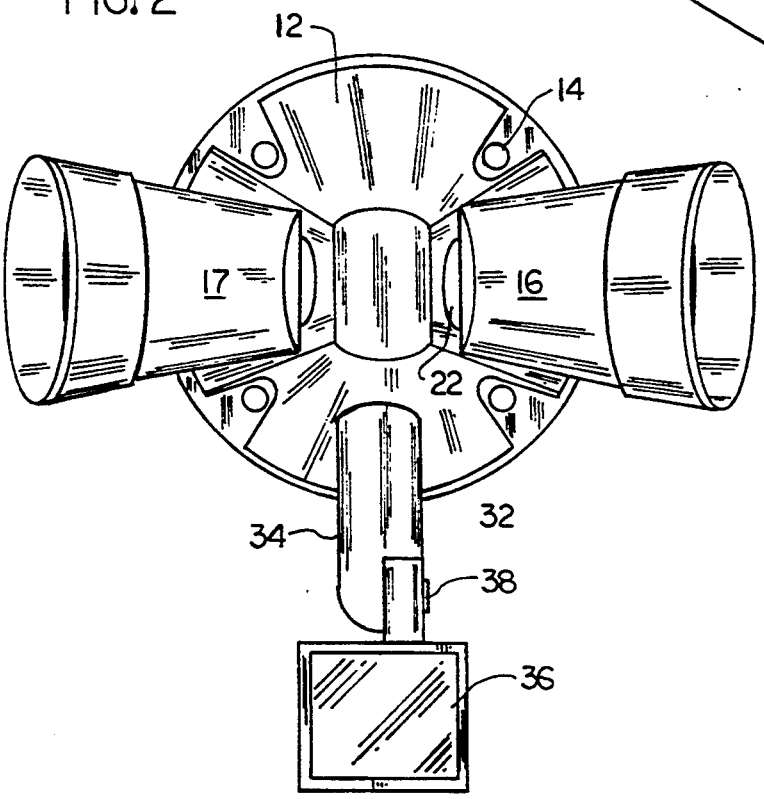
FIG. 2 is a front view of the assembled swivel lighting fixture shown in FIG. 1.

Turning now to FIG. 2, there is shown a front view of the assembled lighting fixture shown in FIG. 1. Preferably, the lower side wall 32 of base 12 includes a mounting post 34 for receiving a conventional motion/-night sensor 36. Sensor 36 is attached to mounting post 34 by means of a conventional pivotable joint 38.

As best seen in FIG. 3, ball-and-socket assembly 20 preferably includes a tab 40 mounted on the periphery of hemispherically shaped portion 26. In addition, a ridge 42 is formed in the surface of the inside wall of the base adjacent to ball-and-socket assembly 20. The relative positions of tab 40 and ridge 42 allow lamp holders 16,17 to be rotated with respect to the base along a first axis in a range of about 290°. This range of movement about the first axis provides sufficient movement of the lamp holders 16,17 to allow positioning of the holders without allowing the lamp holders 16,17 to be rotated so far as to twist electrical leads 18 and to cause a short.

Turning to FIG. 4, there is shown a top view of the assembled lighting fixture illustrating the second range in movement in the horizontal plane with respect to the base 12. As can be seen, the bottom surface 44 of lamp holders 16,17 adjacent to semi-spherical portion 22 is formed of an angle of approximately 90°. The angle of bottom surface 44 cooperates with the side walls of base 12 to permit lamp holders 16,17 to be rotated with a range of movement from a first position approximately perpendicular to the side walls of base 12 to a second position approximately 45° with respect to the side walls of base 12. In addition, rectangular slot 27 located in hemispherical shaped portion 26 permits movement of stem 24.

This range of movement allows the lights to be positioned from approximately 45° with respect to the mounting surface of base 12 to approximately 90° with respect to the mounting surface of base 12. The combination of the range of movement about the first axis shown in FIG. 3 and the second axis as shown in FIG. 4 permits lamp holders 16,17 to be positioned so as to provide illumination over a large spacial area.

Finally, turning to FIG. 5, there is shown an enlarged sectional view of the swivel assembly 20 of the lighting fixture of the present invention. As can be seen, lamp holders 16 includes a lamp base receptacle 46 which may be mounted to mounting post 48. Passageway 52 extends through semi-spherical portion 22, threaded stem 24, and retaining means 28. Sealing means 30 is formed with a compound angle by which one surface is held in place between inner surface of spherical shaped portion 26 and the surface of semi-spherical portion 22 and the other surface is held in place between hemispherical shaped portion 26 and the wall of base 12 adjacent to aperture 31. This arrangement between hemispherical shaped portion 26 and sealing means 30 allows both control of the tension on the lamp holder ball while, at the same time, providing an environmental seal between lamp holder 16,17 and base 12.

Certain modifications and improvements will occur to those skilled in the art upon a reading of the foregoing description. By way of example, the sealing means 30 could be replaced by a conventional O-ring having a sufficient diameter and cross-sectional area to contact both the surface of semi-spherical portion 22 and the wall of base 12 adjacent to aperture 31. It should be understood that all such modifications and improvements have been deleted herein for the sake of conciseness and readability but are properly within the scope of the following claims.

I claim:

1. A lighting fixture, said fixture comprising:

(a) a lampholder for receiving a floodlight or the like;

(b) a base for establishing electrical and mechanical connections with a source of electrical power, said base having a circular aperture for receiving one end of said lampholder; and (c) a ball and socket assembly connected between said base and the end of said lampholder for supporting said lampholder and permitting said lampholder to be manually positioned with respect to said base; said assembly including: (i) a semi-spherically shaped portion attached to said one end of said lampholder and having a diameter larger than the diameter of said circular aperture in said base thereby preventing its passage through said circular aperture; (ii) a stem portion attached to said semi-spherically shaped portion and aligned perpendicularly to the surface of said semi-spherically shaped portion and extending through said circular aperture; (iii) a hemispherical shaped portion adapted to mate with said semi-spherically shaped portion and having an elongated slotted aperture for receiving said stem; and (iv) retaining means attached to said stem for applying a predetermined force on said hemispherical shaped portion.

2. The fixture according to claim 1, further including sealing means located between said hemispherical shaped portion and the surface of said base adjacent to said aperture.

3. The fixture according to claim 2, wherein said sealing means includes a first concave surface in contact with said semi-spherically shaped portion and a second, substantially planar, surface adjacent to said aperture for forming a seal between said aperture and said semi-spherically shaped portion.

4. The fixture according to claim 1, wherein said lampholder is a tubular shaped member having an open end for receiving the base of said floodlight.

5. The fixture according to claim 4, further including an electrical lamp socket mounted in said lampholder for receiving the base of said floodlight, 6. The fixture according to claim 1, wherein said base includes means for mounting said base to a flat surface.

7. The fixture according to claim 6, wherein said means for mounting said base to a flat surface includes a plurality of recessed apertures located along the periphery of said base for receiving a plurality of threaded fasteners for engaging said flat surface, 8. The fixture according to claim 1, wherein said base is a truncated polygon.

9. The fixture according to claim 8, wherein said base is substantially a truncated pyramid.

10. The fixture according to claim 9, wherein said truncated pyramid includes two opposed sides forming an included angle of about 50 degrees.

11. The fixture according to claim 8, wherein said truncated pyramid includes two opposed sides forming an arcuate surface.

12. The fixture according to claim 11, wherein one of said opposed sides forming an arcuate surface includes an elongated member perpendicular to the central axis of said base for supporting a sensor assembly.

13. A ball and socket assembly connected between a base and an end of a lampholder for supporting said lampholder and permitting said lampholder to be manually positioned with respect to said base said base including a circular aperature therein, said assembly comprising:

(a) a semi-spherically shaped portion attached to said one end of said lampholder and having a diameter larger than the diameter of said circular aperture in said base thereby preventing its passage through said circular aperture;

(b) a stem portion attached to said semi-spherically shaped portion and aligned perpendicularly to the surface of said semi-spherically shaped portion and extending through said circular aperture;

(c) a hemispherical shaped portion adapted to mate with said semi-spherically shaped portion and having an elongated slotted aperture for receiving said stem; and (d) retaining means attached to said stem for applying a predetermined force on said hemispherical shaped portion.

14. The assembly according to claim 13, wherein said stem includes a generally rectangular shaped lower portion adapted to mate with the walls of said elongated slotted aperture to prevent rotational movement between said stem and said hemispherical shaped portion.

15. The assembly according to claim 13, wherein said stem is threaded and said retaining means is a nut.

16. The assembly according to claim 15, wherein the lower surface of said nut adjacent to said hemispherical shaped portion is adapted to conform to the outer surface of said hemispherical shaped portion.

17. The assembly according to claim 13, wherein said semi-spherically shaped portion, said stem, and said retaining means define a continuous passageway for electrical wires for electrically connecting said base to said lampholder.

18. The assembly according to claim 13, wherein the longitudual axis of said stem is substantially parallel to the longitudual axis of said lampholder.

19. A lighting fixture, said fixture comprising:

(a) a lampholder for receiving a floodlight or the like;

(b) a base for establishing electrical and mechanical connections with a source of electrical power, said base having a circular aperture for receiving one end of said lampholder; and (c) a ball and socket assembly connected between said base and the end of said lampholder for supporting said lampholder and permitting said lampholder to be manually positioned with respect to said base; said assembly including: (i) a semi-spherically shaped portion attached to said one end of said lampholder and having a diameter larger than the diameter of said circular aperture in said base thereby preventing its passage through said circular aperture; (ii) a stem portion attached to said semi-spherically shaped portion and aligned perpendicularly to the surface of said semi-spherically shaped portion and extending through said circular aperture; (iii) a hemispherical shaped portion adapted to mate with said semi-spherically shaped portion and having an elongated slotted aperture for receiving said stem; sealing means located between said hemispherical shaped portion and the surface of said base adjacent to said aperture; and (v) retaining means attached to said stem for applying a predetermined force on said hemispherical shaped portion.

20. The fixture according to claim 19, wherein said sealing means includes a first concave surface in contact with said semi-spherically shaped portion and a second, substantially planar, surface adjacent to said aperture for forming a seal between said aperture and said semi-spherically shaped portion.

21. The fixture according to claim 19, wherein said lampholder is a tubular shaped member having an open end for receiving the base of said floodlight.

22. The fixture according to claim 21, further including an electrical lamp socket mounted in said lampholder for receiving the base of said floodlight.

23. The fixture according to claim 19, wherein said base includes means for mounting said base to a flat surface.

24. The fixture according to claim 23, wherein said means for mounting said base to a flat surface includes a plurality of recessed apertures located along the periphery of said base for receiving a plurality of threaded fasteners for engaging said flat surface.

25. The fixture according to claim 19, wherein said base is a truncated polygon.

26. The fixture according to claim 25, wherein said base is substantially a truncated pyramid.

27. The fixture according to claim 26, wherein said truncated pyramid includes two opposed sides forming an included angle of about 50 degrees.

28. The fixture according to claim 25, wherein said truncated pyramid includes two opposed sides forming an arcuate surface.

29. The fixture according to claim 28, wherein one of said opposed sides forming an arcuate surface includes an elongated member perpendicular to the central axis of said base for supporting a sensor assembly.

30. The assembly according to claim 19, wherein said stem includes a generally rectangular shaped lower portion adapted to mate with the walls of said elongated slotted aperture to prevent rotational movement between said stem and said hemispherical shaped portion.

31. The assembly according to claim 19, wherein said stem is threaded and said retaining means is a nut.

32. The assembly according to claim 31, wherein the lower surface of said nut adjacent to said hemispherical shaped portion is adapted to conform to the outer surface of said hemispherical shaped portion.

33. The assembly according to claim 19, wherein said semi-spherically shaped portion, said stem, and said retaining means define a continuous passageway for electrical wires for electrically connecting said base to said lampholder.

34. The assembly according to claim 19, wherein the longitudual axis of said stem is substantially parallel to the longitudual axis of said lampholder.

* * * * *